United States Patent [19]

Bass

[11] 4,277,918

[45] Jul. 14, 1981

[54] METHOD AND APPARATUS FOR CONTROLLING SHOT-BLASTING MACHINES

[75] Inventor: Dieter Bass, Schaffhausen, Switzerland

[73] Assignee: Georg Fischer Aktiengesellschaft, Switzerland

[21] Appl. No.: 30,824

[22] Filed: Apr. 17, 1979

[30] Foreign Application Priority Data

Apr. 21, 1978 [CH] Switzerland ..... 4319/78

[51] Int. Cl.[3] ..... B24C 3/30; B24C 7/00; B24C 1/00

[52] U.S. Cl. ..... 51/415; 51/423; 51/319

[58] Field of Search ..... 51/415, 422, 423, 319, 51/320, 321

[56] References Cited

U.S. PATENT DOCUMENTS

| | | | |
|---|---|---|---|
| 1,770,013 | 7/1930 | Rich | 51/422 |
| 2,116,160 | 5/1938 | Rosenberger | 51/415 |
| 2,305,451 | 12/1942 | Turnbull | 51/423 |
| 3,300,903 | 1/1967 | Kosar | 51/422 X |
| 3,546,816 | 12/1970 | Enegren | 51/423 |
| 3,585,758 | 6/1971 | Harper | 51/422 |
| 3,603,036 | 9/1971 | Reed | 51/422 |

FOREIGN PATENT DOCUMENTS

| | | | |
|---|---|---|---|
| 109648 | 7/1899 | Fed. Rep. of Germany | 51/422 |
| 2424086 | 11/1975 | Fed. Rep. of Germany | 51/422 |
| 2359047 | 2/1978 | France . | |

*Primary Examiner*—Gary L. Smith

*Attorney, Agent, or Firm*—Roylance, Abrams, Berdo & Farley

[57] ABSTRACT

A process and apparatus for the regulation of continuously operating shot-blasting machines for achieving an approximately uniform shot-blasting effect on the workpieces independently of time variations in throughput of the workpieces. Throughput speed of the workpieces in the radiation chamber or the supply of shot-blasting medium to one or more centrifugal impellers is regulated in dependence on the quantity of workpieces to be blasted per time unit. The apparatus includes measuring apparatus (9, 9') for the measurement of the fed-in-workpieces (5), disposed in the radiation chamber (1) or in the feed-in arrangement (2), which measuring arrangement is connected by way of a measuring transducer (10) with a regulating circuit (11) for the change of the throughput speed of the workpieces (5) and/or with a regulating circuit (12) for the change of the throughput radiation means at the flywheel (4). The regulation is suitable for shot-blasting machines for drummable workpieces and guarantees lower machine wear and consumption of blasting medium.

22 Claims, 4 Drawing Figures

METHOD AND APPARATUS FOR CONTROLLING SHOT-BLASTING MACHINES

This invention relates to a process and apparatus for the regulation of continuously operating shot-blast machines with time variables throughput of drummable workpieces, and particularly for continuous drum blasting machines with centrifugal blasting medium impellers.

BACKGROUND OF THE INVENTION

Various types of continuously operating shot-blasting machines are known, such devices being used for drummable workpieces which are to be blasted on all sides wherein, for example, plate conveyors with turning arrangements or step-like vibrating conveyors are used for the transportation of the workpieces through a blasting chamber. Preferably, however, such machines are made as continuous drum blasting machines with a rotating drum or a swiveling drum (as shown, respectively, in German Pat. No. 109,648 and German Offenlegungsschrift No. 24 24 086), the drum constituting the blasting chamber. The feed of the workpieces is achieved by screw conveyors disposed in the drum or by conical drums in which the drums can be slanted in the direction of conveyance. Also, continuous blasting machines with a feed and a discharge drum and a belt trough disposed in the radiation chamber for the revolution of the workpieces has been known as shown in German Offenlegungsschriften No. 20 16 429.

In all of these continuous shot-blasting machines, great differences in operation occur in the rate of delivery of the incoming articles, with the result that variable quantities of different types of workpieces must be blasted in succession. Such variations occur, for example, when the blasting apparatus is in direct connection with automatic molding and casting installations which have a sporadic output, or in the event that breakdowns develop in preceding treatment steps. These variations in throughflow, which are to be expected, can occur according to experience in a ratio in the order of 1:20, and the inflow can drop to zero from time to time. Whenever the adjustment of the blasting machine is not adapted to such differences in throughput, then the danger exists that the workpieces can either be over or under blasted, or that excessive wear and tear can occur in the parts of the machine such as, for example, the blasting medium impellers and the protective linings, or that an unnecessarily great consumption of the blasting medium occurs. In any of these cases, it will be clear that the machine operates uneconomically.

BRIEF DESCRIPTION OF THE INVENTION

Accordingly, it is one object of the invention to provide a process for the automatic control of shot blasting equipment such that the operating conditions of the continuous shot-blasting machine is adapted automatically to the relevant throughput of workpieces.

A further object is to provide an apparatus in which the operation of the machine is adapted to load conditions in the sense of variations in the quantity of material to be treated.

Briefly described, the invention includes a process for the regulation of continuously operating shot-blasting machines to which the supplied quantity of workpieces to be processed varies with time, especially machines of the type having centrifugal impellers, comprising the steps of determining the quantity of workpieces to be shot-blasted per unit time, and controlling at least one of the rate of passage of the workpieces through the machine and the supply of blasting medium to the impellers as a function of the determined workpiece quantity to obtain a substantially uniform blasting effect on the processed pieces.

In another aspect, the invention includes an apparatus for the continuous processing of workpieces of a type having a rotatable drum and centrifugal blasting medium impeller means for shot-blasting workpieces in the drum, and wherein the supply of the quantity of workpieces to the drum varies with time, the apparatus including transducer means for measuring the quantity of workpieces to be blasted per unit time and for producing a signal representative of that quantity, means coupled to the drum for controlling the rate of passage of the workpieces through the drum, and a regulating circuit coupled to the means for controlling and responsive to the signal from the transducer means for varying the workpiece rate of passage as a function of workpiece quantity whereby a substantially uniform blasting effect on the workpieces is achieved independently of the quantity supplied.

A further aspect of the invention includes an apparatus for the continuous processing of workpieces of the type having a rotatable drum and centrifugal blasting medium impeller means for shot blasting workpieces in the drum, and wherein the supplied quantity of workpieces to the drum varies with time, the apparatus including transducer means for measuring the quantity of workpieces to be blasted per unit time and for producing a signal representative of that quantity, means coupled to the impeller means for controlling the amount of blasting medium supplied to said impeller means, and a regulating circuit coupled to said means for controlling and responsive to the signal from said transducer means for varying the amount of blasting medium supplied as a function of workpiece quantity whereby a substantially uniform blasting effect on the workpieces is achieved independently of the quantity supplied.

Additionally, the apparatus of the invention can concurrently include means for controlling throughput speed and blasting medium quantity supplied, both of these being varied as a function of workpiece quantity.

Regulating arrangement according to the invention will thus guarantee workpieces uniformly blasted on all sides during the entire operating time and has the further advantages, in the case or relatively small feed-in of workpieces and, at times, no supply of workpieces, that the centrifugal impellers and the blasting chamber are protected against unnecessary wear and tear by reduction of the supply to the blasting means and, also, the consumption of blasting medium is reduced.

Shot-blasting machines provided with such regulation can be connected directly with an automatically controlled molding and casting installation resulting, with a minimum use of personnel, in an operationally safe system at more favorable cost.

The preferable regulation of the throughput speed by means of regulation of the rotational speed of the drum and the measurement of the quantity of workpieces to be blasted per unit time by means of a torque measurement of the drum drive, makes possible an uncomplicated construction of the installation, this being particularly true when the torque is measured by means of the measurement of oil pressure in an hydraulic drum drive. In this form of the system, instruments which are known to operate reliably, such as an oil pressure gauge used as a measuring device and a regulatable hydraulic motor used as an adjusting member and a speedometer as an actual value generator, result in a particularly advantageous and reliable system. In an electrical embodiment of the apparatus, a simple and reliable apparatus is arrived at by using a throttle valve as an adjusting member and a current and performance indicator of a centrifugal impeller drive motor as an actual value generator in the regulation circuit for the feeding in of the blasting medium.

In order that the manner in which the foregoing and other objects are attained in accordance with the invention can be understood in detail, particularly advantageous embodiments thereof will be described with reference to the accompanying drawings, which form a part of the specification, and wherein.

Figure 1:
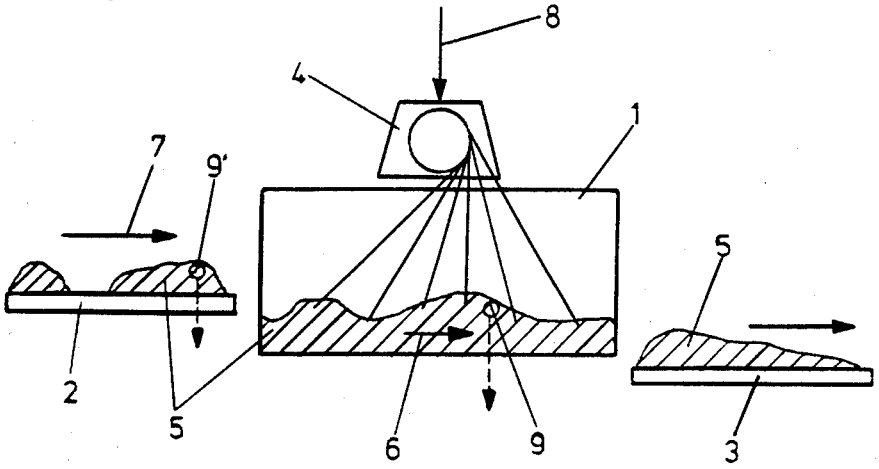
FIG. 1 is a highly simplified schematic diagram of a shot blasting machine showing the general arrangement of major components and the flow of various workpiece quantities.

As seen in FIG. 1, the shot-blasting machine schematically illustrated therein includes a blasting chamber 1, an apparatus 2 for delivering workpieces to the shot-blasting machine, and an apparatus 3 for removing processed workpieces from the output end of the shot-blasting chamber. The machine includes a centrifugal impeller 4 associated with the blasting chamber for impelling blasting medium against the workpieces in the drum, the blasting medium being abrasive particles or shot, the selection of the type of medium being a function of the nature of the workpieces being processed. As is well recognized in this art, various types of articles can be processed in this fashion, including articles made of metal and plastic as well as elastomeric materials such as rubber. The nature of the blasting medium selected for a particular use is thus a function of the workpiece material. This choice is not a part of the present invention and will therefore not be further described herein. Workpieces of a type which can be processed in machines of this general category are referred to as "drummable" workpieces.

Quantities of the drummable workpieces 5 are supplied by a conveyor apparatus 2 to the blasting chamber 1 and are revolved therein for the purpose of exposing all sides of each workpiece to the blasting medium, obtaining a blasting effect on all surfaces thereof, and are conveyed from the input end of the blasting chamber 1 to the output end thereof at an average speed $V_w$ in the direction of the arrow 6. The blasting chamber can be constructed with, for example, a through-shaped band or belt, not shown in detail, in order to rotate the workpieces 5. The longitudinal passage of the workpieces can be accomplished by various means such as, for example, driving bridges slantingly disposed on the revolving belt, by a trough in the belt placed obliquely, or by an additional longitudinal conveyor belt.

As a result of a continuously varying influx of the workpieces 5, varying degrees of filling of the blasting chamber 1 will result, the variable influx in the direction of arrow 7 being schematically indicated by the irregular quantities of material on the supply means. As a result of this variable influx, it is possible to obtain a substantially constant specific blasting performance only by regulation of the throughput speed $V_w$ and/or of the rate of supply of blasting medium as indicated by the arrow 8 to the impeller means. The specific blasting performance is defined as a predetermined quantity of blasting medium impinging per unit of surface area of the workpiece (in square centimeters) per unit time (in seconds).

The measurement of the workpieces 5 to be blasted per unit time can take place in the blasting chamber 1 by means of a measuring arrangement 9 associated with the chamber itself or by a measuring arrangement 9' associated with the feed-in apparatus 2. This measurement can be accomplished in various ways including a measurement of the weight of the workpieces supplied, a measurement of $\gamma$-ray absorption, by an electrical inductive or capacitive measurement, by an optical-electrical measurement, or by means of ultrasonics.

Preferably, one of these previously mentioned contactless methods of measurement can be employed for the measurement of the degree of filling of the blasting chamber 1. For the $\gamma$-ray measurement, a radioactive radiation source is disposed outside the blasting chamber and a countertube is disposed on an opposite side of the blasting chamber. An induction measurement can be accomplished by detecting a change in the electromagnetic induction flux in a coil winding surrounding the blasting chamber, also accomplishing a non-contact measurement of the degree of filling of the chamber. The weight of the articles can be employed by weighing the total weight of the blasting chamber plus the content attributable to workpieces, or the measurement of the driving moment required for the revolution of the blasting chamber, the latter being accomplished by connecting a torque dynamometer to an electric drive of the drum or by means of the measurement of the supply pressure in a pump if the drum drive is hydraulic.

The measurement of the quantity of workpieces supplied to the blasting chamber can also be accomplished with the above-mentioned measuring techniques at the feed-in arrangement 2 by a continuous weighing by means of a known horizontal conveyor type weigher or by a discontinuous measurement of the weight of a reciprocating feeder or a shuttle conveyor, including the weight of the workpieces. In the last mentioned example, the conveyor drive is periodically disconnected for the duration of a weighing, such that the weighing is accomplished statically. A further measuring method will be described in connection with the embodiment of FIG. 3.

Figure 2:
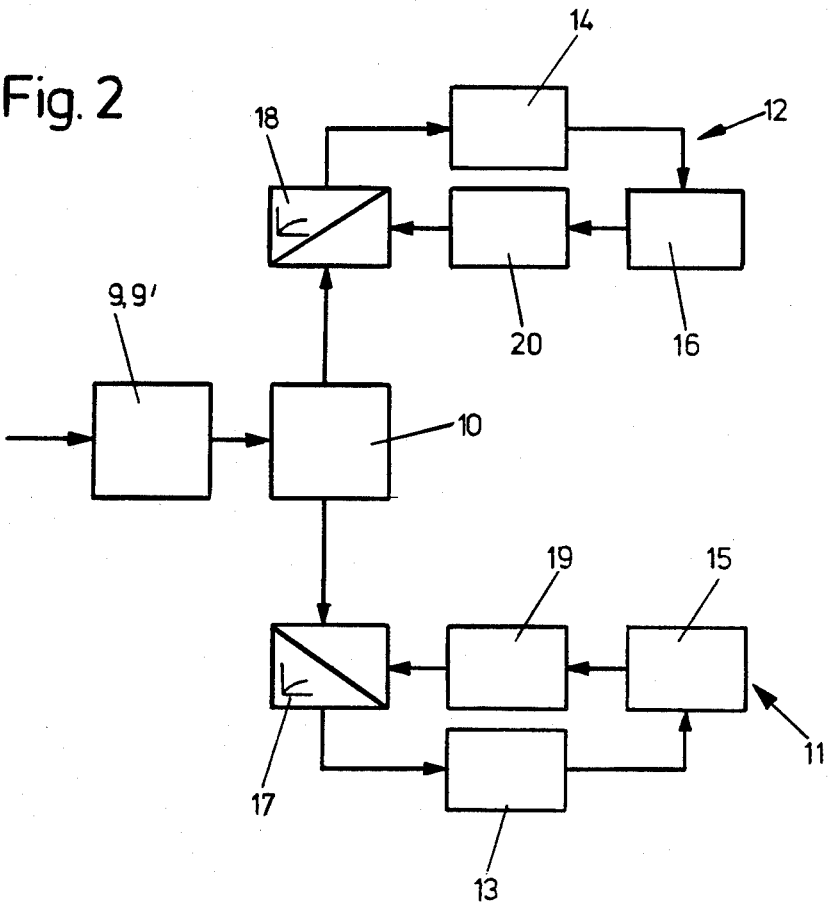
FIG. 2 is a schematic diagram, in block form, of a system for the regulation of a shot-blasting machine.

In FIG. 2, there is shown a schematic diagram, in block form, for the regulation of a shot-blasting system according to FIG. 1. A signal representative of the number or quantity of workpieces located in the blasting chamber 1 which has been fed in and measured by means of one of the measuring devices 9 or 9' is supplied as an actual value to a measurement transducer 10, the electrical output signals of wich are fed to a regulating circuit 11 as desired values for the change of the throughput speed of the workpieces 5 in the blasting chamber 1 and is also fed to a regulating or control circuit 12 for changing the volume of delivery of blasting medium to the centrifugal impeller 4. Each of regulating circuits 11 and 12 includes a regulator 17 or 18 with a regulating behavior or transfer function predetermined for the purpose of the system, an adjusting member 13 or 14 of an actual value generator, a measuring arrangement 15 or 16 for the measurement of the regulated value, and a measurement transducer 19 or 20 which produces an electrical signal proportional to the actual value and feeds that signal to the regulator 17 or 18.

Figure 3:
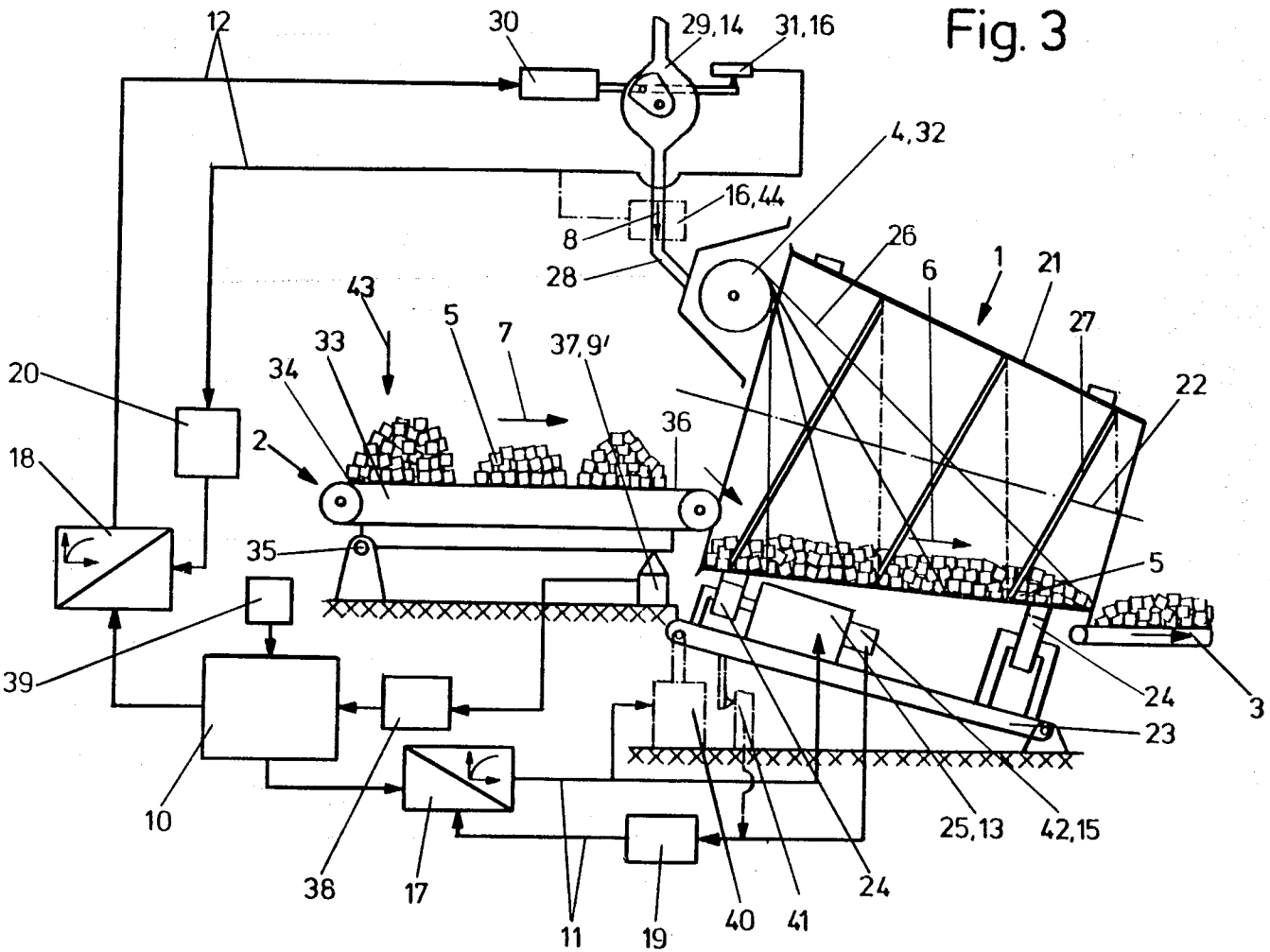
FIG. 3 is a schematic diagram of a shot-blasting machine and control means therefor, partly in block form.

FIG. 3 shows in somewhat more detail the application of a regulating system of the type shown in FIG. 2 to a shot blasting machine. In the embodiment shown, the blasting chamber 1 is formed as a rotating conical drum 21, the rotational axis 22 of which is inclined with respect to the horizontal. Drum 21 is rotatably mounted on rollers 24 which are mounted on a frame 23, at least one of the rollers being driven by a drive motor 25, the speed of which can be varied.

A centrifugal impeller 4 is disposed at the end of the drum having the larger diameter, the impeller being such that a fan-shaped pattern of blasting medium is directed into the drum interior in such a way that it substantially covers the entire region of the drum occupied by workpieces. Means defining a screw conveyor 27 is disposed on the inside wall of the drum by which the revolving workpieces are conveyed in the direction or arrow 6 through the blasting chamber 1 at a throughput speed $V_w$ which is a function of the rotational speed of the drum. Instead of the screw conveyor 27, one can also employ a stepped drum with driving bridges extending axially in the drum, in which case a conveying effect which is a function of drum rotational speed likewise develops.

In a feed line 28 for the supply of blasting medium to the centrifugal impeller 4, there is disposed a throttle valve 29 which is operatively connected with a servo mechanism 30 which can be, for example, a piston and cylinder assembly, for adjusting the position of the throttle valve. A position-indicating mechanism 31, such as a linear transmitter, can also be coupled to the valve for producing a signal representative of valve position.

The throttle valve 29 with the servo mechanism 30 forms an adjusting member 14 and the position indicator 31 forms an actual value transmitter 16 of the regulating circuit 12 for the supply of the blasting medium. A measuring arrangement 44 to measure the supplied quantity of blasting medium, supplied in the direction indicated by arrow 8, and disposed in the supply line 28 for the blasting medium can alternatively be used as the actual value transmitter 16. This variation of the embodiment of FIG. 3 is shown in dash-dot lines. The flow measuring variation can be accomplished, for example, by measuring the inductance of a coil in which the inductance changes as a function of the degree of filling of the supply line 28 with the blasting medium. In front of the blasting chamber 1 (at the input end thereof), there is a feed-in arrangement 2 which is formed as a balance, and behind the blasting chamber (at the output end thereof) is a removal apparatus 3 for removing workpieces 5 which have been processed in the chamber. The feed-in apparatus 2 consists of a conveyor belt 33 having a support structure one end of which is pivotably mounted in a bearing 35 at the input end thereof and is supported at the discharge end thereof by at least one pressure measuring arrangement 37 which can be a weight-responsive transducer or a pressure cell of any conventional form.

The electrical signal produced by the pressure measuring arrangement 37 is fed through an amplifying unit 38 to the measuring transducer 10 wherein an electronic formation of the average value is carried out with adjustable time constant by a time advance instrument 39. The theoretical value signal required for the regulating circuits 11 and 12 is thus changed at the end of each of a series of discrete time intervals.

The impact pulses which occur at the input end 34 of conveyor belt 33 by the delivery of the workpieces 5 in the direction of arrow 43 will influence the weighing only minimally because of the lever arrangement of the structure, and the fact that the quantities of the workpieces which are on the conveyor belt just before their delivery to the chamber at the delivery end 36 of the conveyor belt have a somewhat greater effect on the weight measurement and the regulation than those which are still far away from the blasting chamber. Only in the case of uniform loading of the conveyor belt will there be any absolute weighing, whereas in the case of short time fluctuations in loading, the fluctuations of the theoretical value are smoothed out as a result of the formation of the mean value. This weighing arrangement can also be used for feed-in arrangements which employ vibration or shuttle conveyor chutes wherein the weighing must be accomplished intermittently after periodic switching off of the conveyor drive.

The regulating circuit 11 for the pass-through speed described in connection with FIG. 2 has, in the case of the embodiment shown in FIG. 3, as an adjusting member 13 the speed regulatable motor 25 for the drive of the drum, wherein a speedometer 42 is preferably added as an actual value transmitter 15, the electrical signals produced thereby being fed to regulator 17 by way of the measurement transducer 19.

It is also possible to regulate the throughput speed $V_w$ of the workpieces 5 by a change in the inclination of the drum, which technique is preferably used in the case of those drums not having positive conveying means of the type such as screw conveyor 27. In this alternative form, the pivotably articulated frame 23 is lifted or lowered at one end by an adjusting drive 40, for example, by an elevating spindle, as a result of which the slope of the rotational axis 22 is changed. The actual value transmitter 15 is a linear transmitter 41 in this arrangement, this variation of the embodiment of FIG. 3 being shown in dash-dot lines.

In the case of a few types of continuous blasting machines and/or under certain supply conditions of the workpieces, it is often possible to accomplish the necessary regulation of the blasting medium to one or more centrifugal impellers by means of the regulating circuit 12 by itself, this being sufficient to achieve an approximately uniform blasting effect on all parts of the workpieces.

Figure 4:
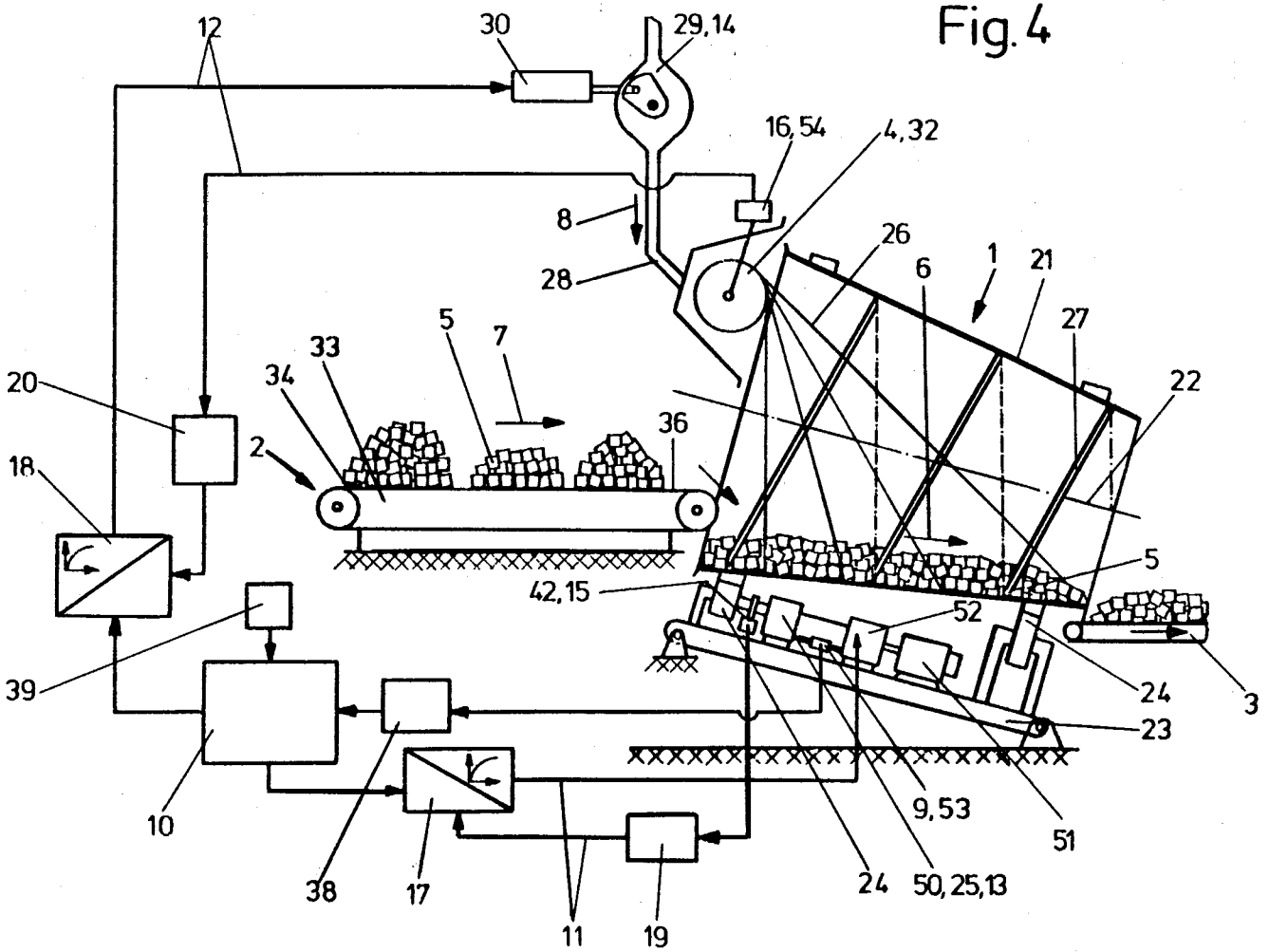
FIG. 4 is a schematic diagram of a further embodiment of a shot-blasting machine and control means therefor in accordance with the invention, partly in block form.

FIG. 4 shows a further embodiment of an apparatus in accordance with the invention wherein the measurement of the degree of filling of the blasting chamber is accomplished by means of a measurement of the torque in the drum drive.

As shown therein, a drive motor 25, the speed of which is regulatable, is illustrated as an hydraulic motor 50 which is supplied with oil under pressure by means of a pump 51 driven by an electric motor though a control device 52. The measuring apparatus 9 accomplishes a torque measurement and includes an oil pressure gauge transducer 53 which produces electrical signals proportional to pressure. The signals corresponding to the torque existing in the drum drive are delivered to the measurement transducer 10 through amplifier unit 38. Furthermore, the regulating circuit 11 corresponds to that already described in connection with FIG. 3, wherein a speedometer 42, used as an actual value transmitter 15, is disposed between the hydraulic motor 50 and the roll 24. The signals originating from regulator 17 are transmitted to the control device 52 where the quantity of oil fed to hydraulic motor 50 and, thus, the rotational speed of the drum is changed, thereby regulating the flow-through speed $V_w$ of workpieces 5 through the drum 21.

The feed-in arrangement 2 at the input end of the blasting chamber is formed, in this embodiment, as a fixed conveyor belt 33. In the regulating circuit 12 for the change of the supply of blasting medium, the actual value transmitter 16 is a current or performance recorder 54 of the motor 32 for the centrifugal impeller drive. The remaining construction of the regulating circuit 12 and the use of throttle valve 29 as an adjusting member 14 corresponds to the structure described previously in connection with FIG. 3.

While certain advantageous embodiments have been chosen to illustrate the invention, it will be understood by those skilled in the art that various changes and modifications can be made therein without departing from the scope of the invention as defined in the appended claims.

What is claimed is:

1. A process for the regulation of continuously operating shot-blasting machines to which the supplied quantity of workpieces to be processed varies with time, wherein the machines are of the type having a blasting chamber and centrifugal impellers for impelling a blasting medium against the workpieces, comprising the steps of:

determining the quantity of workpieces to be shot-blasted per unit time, and controlling at least one of the rate of passage of the workpieces through the machine and the supply of blasting medium to the impellers as a function of the determined workpiece quantity to obtain a substantially uniform blasting effect on the processed pieces.

2. A process according to claim 1 wherein the step of determining the quantity of workpieces is determined by measuring the quantity of workpieces located in the blasting chamber.

3. A process according to claim 1 wherein the step of determining the quantity of workpieces includes measuring the quantity of workpieces being delivered to the blasting chamber.

4. A process according to claim 2 or 3 wherein the step of determining the quantity of workpieces includes weighing the workpieces.

5. A process according to claim 2 or 3 wherein the step of determining the quantity of workpieces includes measuring the absorption of $\gamma$ rays by workpieces.

6. A process according to claim 2 or 3 wherein the step of determining the quantity of workpieces includes detecting an electrical characteristic of the workpieces such as inductance or capacitance.

7. A process according to claim 3 wherein the step of determining the quantity of workpieces includes measuring the volume of the workpieces to be fed to the blasting chamber by optically determining the volume of a mass of workpieces.

8. A process according to claim 3 wherein the step of determining the quantity of workpieces includes ultrasonically measuring the volume of the workpieces collectively.

9. A process according to claim 2 wherein the shot-blasting machine includes a rotatable drum and a drive for rotating the drum, and wherein the step of determining the quantity of workpieces therein includes measuring the torque of the drive for rotating the drum.

10. An apparatus for the continuous processing of workpieces of the type having a rotatable drum and centrifugal blasting medium impeller means for shot blasting workpieces in the drum, and wherein the supply of the quantity of workpieces to the drum varies with time, the apparatus including transducer means for measuring the quantity of workpieces to be blasted per unit time and for producing a signal representative of that quantity;

means coupled to the drum for controlling the rate of passage of the workpieces through the drum; and a regulating circuit coupled to said means for controlling and responsive to the signal from said transducer means for varying the workpiece rate of passage as a function of workpiece quantity whereby a substantially uniform blasting effect on the workpieces is achieved independently of the quantity supplied.

11. An apparatus in accordance with claim 10 wherein said regulating circuit includes a control circuit having a predetermined response characteristic, an adjusting member, an actual value measuring apparatus, and a measuring transducer.

12. An apparatus according to claim 11 which includes a drive for rotating the rotatable drum and wherein the adjusting member comprises a speed regulator for the drum drive for changing the throughput speed of the workpieces.

13. An apparatus according to claim 11 wherein the axis of rotation of the rotatable drum is inclined with respect to the horizontal and wherein the adjusting member includes means for changing the inclination of said axis for changing the speed of throughput of workpieces therethrough.

14. An apparatus according to claim 10 which includes means for delivering quantities of workpieces to said rotatable drum, said means including a balance, and wherein said transducer means includes means for measuring the quantity of workpieces to be delivered to said drum per unit time while on said balance.

15. An apparatus according to claim 14 wherein said balance includes a conveyor belt, mounting means for said belt, said mounting means being pivotably supported at one end, and a pressure measuring device spaced from said one end closer to said rotatable drum for measuring pressure exerted thereon by workpieces being delivered to the rotatable drum.

16. An apparatus according to claim 10 which includes hydraulic drive means for rotating said rotatable drum, said hydraulic means including an hydraulic motor, and wherein said transducer means includes a fluid pressure transducer coupled to said hydraulic motor for measuring the pressure of fluid supplied thereto, and said regulating circuit includes means responsive to said transducer for controlling the speed of said motor.

17. An apparatus according to claim 10 and including amplifier means for amplifying the signal produced by said transducer means, said transducer means comprising means for forming an average value signal over a predetermined interval of time.

18. An apparatus for the continuous processing of workpieces of the type having a rotatable drum and centrifugal blasting medium impeller means for shot blasting workpieces in the drum, and wherein the supply of the quantity of workpieces to the drum varies with time, the apparatus including transducer means for measuring the quantity of workpieces to be blasted per unit time and for producing a signal representative of that quantity;

means coupled to the impeller means for controlling the amount of blasting medium supplied to said impeller means; and a regulating circuit coupled to said means for controlling and responsive to the signal from said transducer means for varying the amount of blasting medium supplied as a function of workpiece quantity whereby a substantially uniform blasting effect on the workpieces is achieved independently of the quantity supplied.

19. An apparatus according to claim 18 wherein said means for controlling includes a throttle valve and a servo control device coupled to said throttle valve, said valve being mounted in a supply line for blasting medium being supplied to said impeller means and responsive to the signal produced by said transducer means for altering the amount of medium supplied to said impeller means.

20. An apparatus according to claim 19 and further comprising an actual value transmitter consisting of a position recorder for indicating the position of the throttle valve.

21. An apparatus according to claim 19 and further comprising an actual value transmitter coupled to said throttle valve, said transmitter comprising means responsive to the impeller means drive for indicating the performance thereof.

22. An apparatus according to claim 19 and further comprising means coupled to the blasting medium conduit for indicating the quantity of blasting medium being fed to said impeller means.

* * * * *